US006874457B2

(12) United States Patent
Gracyalny et al.

(10) Patent No.: US 6,874,457 B2
(45) Date of Patent: Apr. 5, 2005

(54) VACUUM RELEASE MECHANISM

(75) Inventors: Gary J. Gracyalny, Milwaukee, WI (US); John H. Thiermann, Greenfield, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/712,120

(22) Filed: Nov. 13, 2003

(65) Prior Publication Data

US 2004/0112321 A1 Jun. 17, 2004

Related U.S. Application Data

(60) Division of application No. 10/096,456, filed on Mar. 11, 2002, now Pat. No. 6,782,861, which is a continuation-in-part of application No. 09/782,468, filed on Feb. 9, 2001, now Pat. No. 6,494,175.

(51) Int. Cl.[7] ..... F01G 13/08
(52) U.S. Cl. ..... 123/182.1; 123/179.18
(58) Field of Search ..... 123/182.1, 179.18, 123/179.16, 198 D

(56) References Cited

U.S. PATENT DOCUMENTS

| | | | | |
|---|---|---|---|---|
| 838,399 | A | 12/1906 | Greuter | |
| 854,035 | A | 5/1907 | Hansen-Ellehammer | |
| 1,047,499 | A | 12/1912 | Clement | |
| 1,175,820 | A | 3/1916 | Rounds | |
| 1,361,109 | A | 12/1920 | Spohrer | |
| 2,999,491 | A | 9/1961 | Harkness | |
| 3,306,276 | A | 2/1967 | Harkness et al. | |
| 3,314,408 | A | 4/1967 | Fenton | |
| 3,362,390 | A | 1/1968 | Esty | |
| 3,395,689 | A | 8/1968 | Kruse | |
| RE26,462 | E | 9/1968 | Harkness et al. | |
| 3,897,768 | A | 8/1975 | Thiel | |
| 3,981,289 | A | 9/1976 | Harkness | |
| 4,453,507 | A | 6/1984 | Braun et al. | |
| 4,977,868 | A | 12/1990 | Holschuh | |
| 4,991,551 | A | 2/1991 | Terai et al. | |
| 5,085,184 | A | 2/1992 | Yamada et al. | |
| 5,150,674 | A | 9/1992 | Gracyalny | |
| 5,301,643 | A * | 4/1994 | Garcyalny | 123/198 D |
| 5,653,199 | A | 8/1997 | Ishiuchi et al. | |
| 5,687,683 | A | 11/1997 | Knoblauch | |
| 5,809,958 | A | 9/1998 | Gracyalny | |
| 5,943,992 | A | 8/1999 | Kojima et al. | |
| 6,055,952 | A | 5/2000 | Gau | |

(Continued)

FOREIGN PATENT DOCUMENTS

| | | |
|---|---|---|
| EP | 0 515 183 | 5/1992 |
| GB | 1243551 | 8/1971 |
| JP | 60-192207 | 12/1985 |
| JP | 1-103712 | 7/1989 |

*Primary Examiner*—Henry C. Yuen
*Assistant Examiner*—Arnold Castro
(74) *Attorney, Agent, or Firm*—Michael Best Friedrich LLP

(57) ABSTRACT

An internal combustion engine having a centrifugally-responsive vacuum release mechanism that relieves a vacuum within a combustion chamber during the expansion stroke of an engine at engine starting speeds. The vacuum release mechanism is disposed adjacent the cam and engages a cam follower at engine starting speeds to unseat an engine valve while an engine piston is moving toward a crankcase and away from the combustion chamber. When the engine rotation speed reaches a desired kick-out speed, the centrifugal force transitions the vacuum release mechanism from an engaged position to a disengaged position. The vacuum release mechanism engages the cam follower to separate the cam follower from the cam when the vacuum release mechanism is in the engaged position. When the vacuum release mechanism is in the disengaged position during normal operating speeds, the cam follower is permitted to contact the cam throughout the entire rotation of the cam.

32 Claims, 12 Drawing Sheets

U.S. PATENT DOCUMENTS 6,223,708 B1 5/2001 Kampichler et al.
6,343,582 B1 2/2002 Peng
6,394,054 B1 5/2002 Rado et al.
6,536,393 B2 * 3/2003 Novak et al. ..... 123/182.1
2001/0017119 A1 8/2001 Suzuki et al.
2002/0033158 A1 3/2002 Novak et al.

* cited by examiner

VACUUM RELEASE MECHANISM

RELATED APPLICATIONS

This is a divisional of U.S. patent application Ser. No. 10/096,456 filed Mar. 11, 2002 now U.S. Pat. No. 6,782,861 which is a continuation-in-part of U.S. patent application Ser. No. 09/782,468 filed Feb. 9, 2001, now U.S. Pat. No. 6,494,175, which is incorporated herein by reference.

FIELD OF THE INVENTION

This invention relates to internal combustion engines, and more particularly to a centrifugally responsive vacuum release mechanism.

BACKGROUND OF THE INVENTION

In a normal four stroke pull-start engine, a starting event moves the engine through one or more engine cycles to start the engine. The starting event may involve a person pulling a pull cord, or an electric starter, rotating the engine. The engine cycle has four strokes: the intake stroke, the compression stroke, the expansion stroke, and the exhaust stroke.

During normal engine operation, an air/fuel mixture is ignited just before the expansion stroke to power the engine and move the engine through the engine cycle. During pull starting, the operator must exert enough force to overcome the resistive force of the compressed air in the combustion chamber during the combustion stroke. The additional force required to compress the air increases the torque on the cord and makes the engine more difficult to start.

A compression release mechanism may be used to release pressure in the combustion chamber during the compression stroke, which reduces the torque and resistive force on the cord. The reduced torque makes the engine easier to start because the operator does not have to exert as large of a force on the pull cord to move the engine through the cycle. Typically, a compression release mechanism slightly unseats an engine valve to vent the combustion chamber during the compression stroke while the engine is rotating at starting speeds. The compression release mechanism generally disengages at or before the engine reaches normal operating speeds.

The object of the compression release mechanism is to reduce the torque on the cord by releasing the pressure in the combustion chamber during the compression stroke. Since the combustion chamber is relatively airtight when the engine valves are closed, the release of pressure during the compression stroke creates a partial vacuum in the combustion chamber for the expansion stroke. When starting an engine having a compression release mechanism, the operator must exert enough force on the pull cord during the expansion stroke to pull the piston against the partial vacuum in the combustion chamber. The additional force required to overcome the partial vacuum during the expansion stroke creates a torque and the resistive force on the cord, and makes the engine more difficult to start.

SUMMARY OF THE INVENTION

A feature of the invention is to reduce the resistive torque of an internal combustion engine during a starting event. The starting event usually involves a person pulling on the pull cord to start the engine, but the starting event could also include an electric starter rotating the engine through the engine cycle to start the engine. The engine comprises a reciprocable piston, a combustion chamber located on a first side of the piston, a crankcase located on a second side of the piston that is opposite the first side, and a cam shaft. The engine has a valve operating system comprising a cam interconnected to the cam shaft, a cam follower capable of contacting the cam, and an engine valve responsive to movement of the cam follower.

The engine also includes a centrifugally-responsive vacuum release member located near the cam. The vacuum release member engages the cam follower at engine starting speeds to unseat the engine valve while the piston is moving toward the crankcase and away from the combustion chamber.

A mechanical vacuum release slightly unseats the engine valve to relieve the vacuum in the combustion chamber during the expansion stroke while the engine is cranking and running at starting speeds. The unseated engine valve relieves the vacuum by permitting air to enter the combustion chamber during the expansion stroke.

The mechanical vacuum release comprises the vacuum release member, the cam follower, and the engine valve. The vacuum release member is centrifugally-responsive and generally disengages at or before the engine reaches normal operating speeds. The vacuum release member is generally in an engaged position when the engine is rotating at engine starting speeds, and in a disengaged position when the engine reaches normal operating speeds. When the engine speed reaches a desired kick-out speed, centrifugal forces enable the vacuum release member to move from the engaged position to the disengaged position.

The vacuum release member of the invention is illustrated in multiple embodiments. In a first embodiment, the vacuum release member is pivotably interconnected with the cam to pivot between an engaged position and a disengaged position. The vacuum release member includes an engaging portion, a flyweight portion, and a bridging portion. The engaging portion has an arc-shaped cam surface that extends beyond the cam in a radial direction, and engages the cam follower when the vacuum release member is in the engaged position. The flyweight portion has sufficient mass to move the cam surface in response to engine speed. The mass of the flyweight portion is preferably greater than the mass of the engaging portion. The U-shaped bridging portion interconnects the engaging portion and the flyweight portion. The vacuum release member is retained within a slot formed in the cam. The slot extends radially inward into the cam, and is partially defined by two side walls and a back surface. The back surface bears load forces imparted on the vacuum release member by the cam follower.

In a second embodiment, the vacuum release member includes a beam and a blocking member. The beam may be cantilevered with a cam surface near the cam, and a bracket at the end of the beam opposite the cam surface. The bracket interconnects the beam to a cam gear. The cam surface engages the cam follower at engine starting speeds. The blocking member is coupled, preferably pivotably, to the cam shaft, and may move between an engaged position and a disengaged position. A tab may project from the blocking member near the coupling between the blocking member and the cam shaft. When the blocking member is in the engaged position, the tab is located between the beam and the cam shaft, and supports the beam against forces exerted by the cam follower. When the blocking member moves to the disengaged position, the tab moves away from its position between the beam and the cam shaft. Without the blocking member supporting the beam, the cam follower deflects the beam, and the cam follower may contact the cam for the entire engine cycle.

In a third embodiment, the vacuum release member and a compression release member are both interconnected to a single yoke that is pivotably coupled to the cam gear. Two separate tabs project outward from the cam shaft. A vacuum tab projects for the vacuum release member, and a compression tab projects for the compression release member. The yoke may pivot between an engaged position and a disengaged position. When the yoke is in the engaged position, the vacuum tab and compression tab both contact the cam follower as the cam gear rotates. Since the vacuum release member and the compression release member are both interconnected to a single yoke, they both pivot to the disengaged position at the same time.

In a fourth embodiment, the vacuum release member and compression release member are also both interconnected to a single U-shaped yoke that is pivotally coupled to the cam gear. The vacuum release member and the compression release member are bulges that project outward from a closed curved end of the yoke, and are substantially planar with the closed curved end. The yoke has curved U-shaped recesses on legs that extend from the curved closed end to an open end. A pin is disposed in the recesses and retains the yoke. The yoke pivots about the pin, and the yoke may pivot between an engaged position and a disengaged position. When the yoke is in the engaged position, the vacuum release member and compression release member both contact the cam follower as the cam gear rotates.

Figure 1:
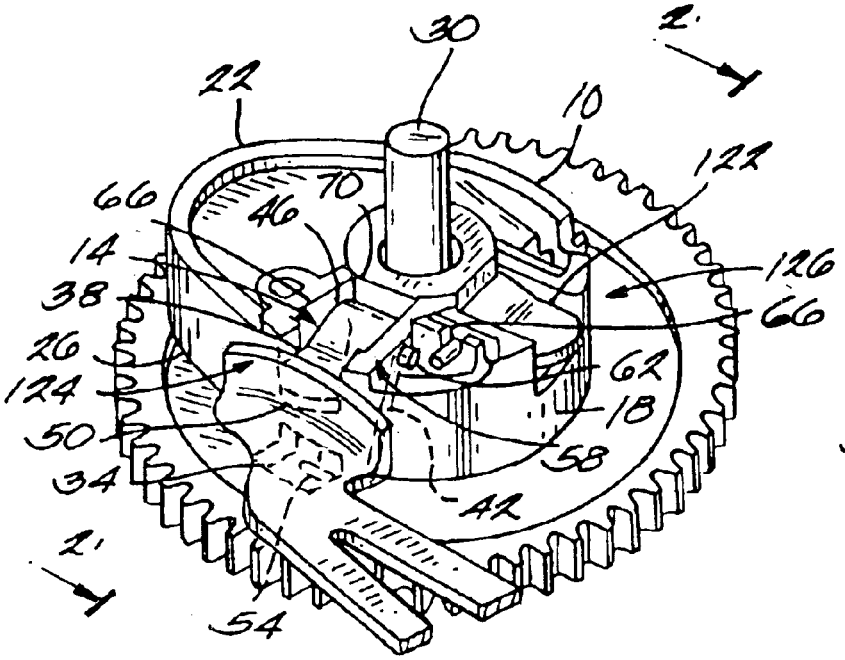
FIG. 1 is a perspective view of a cam and cam follower with a vacuum release member in an engaged position.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 2:
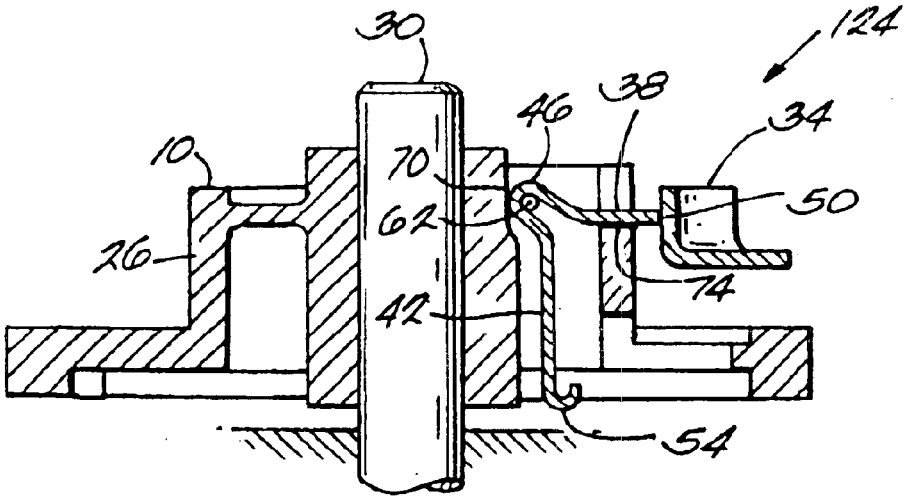
FIG. 2 is a cross-sectional view, taken along line 2—2 of FIG. 1.
Figure 3:
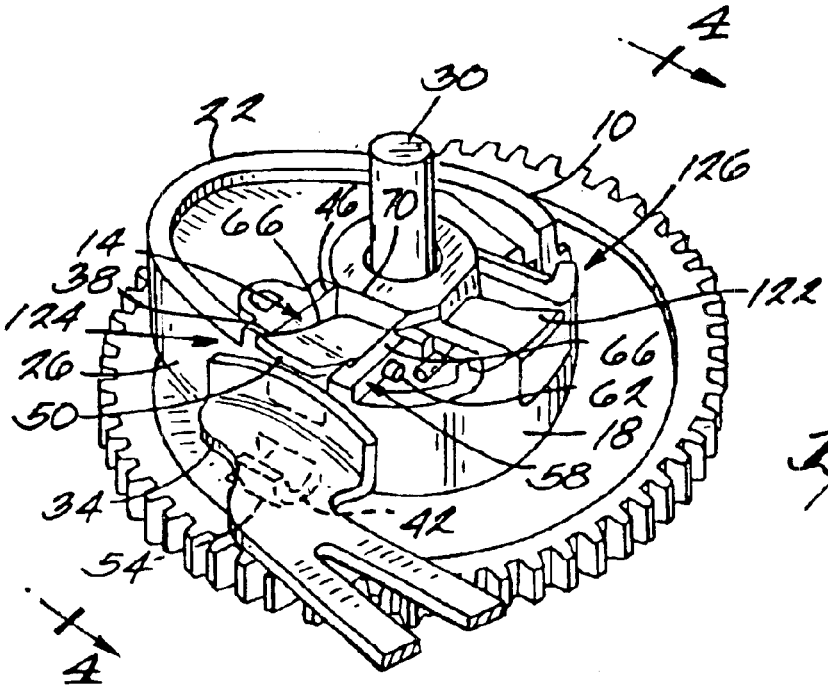
FIG. 3 is a perspective view of a cam and cam follower with a vacuum release member in a disengaged position.
Figure 4:
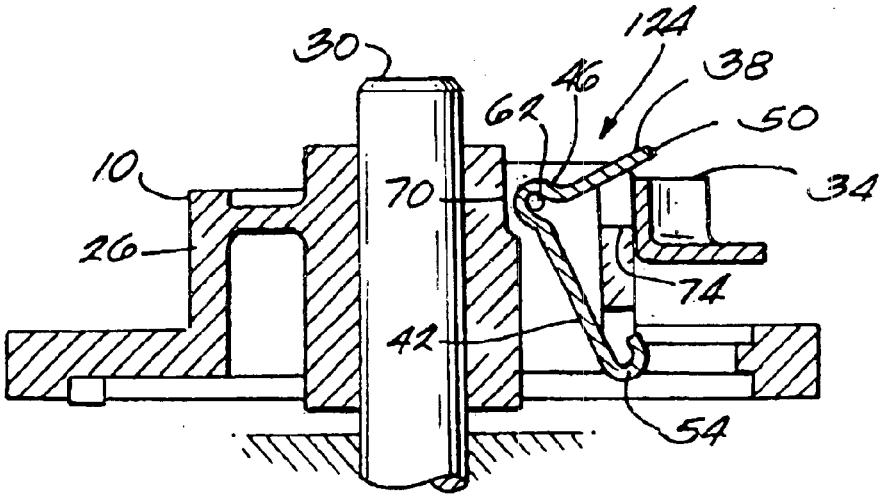
FIG. 4 is a cross-sectional view, taken along line 4—4 of FIG. 1.
Figure 5:
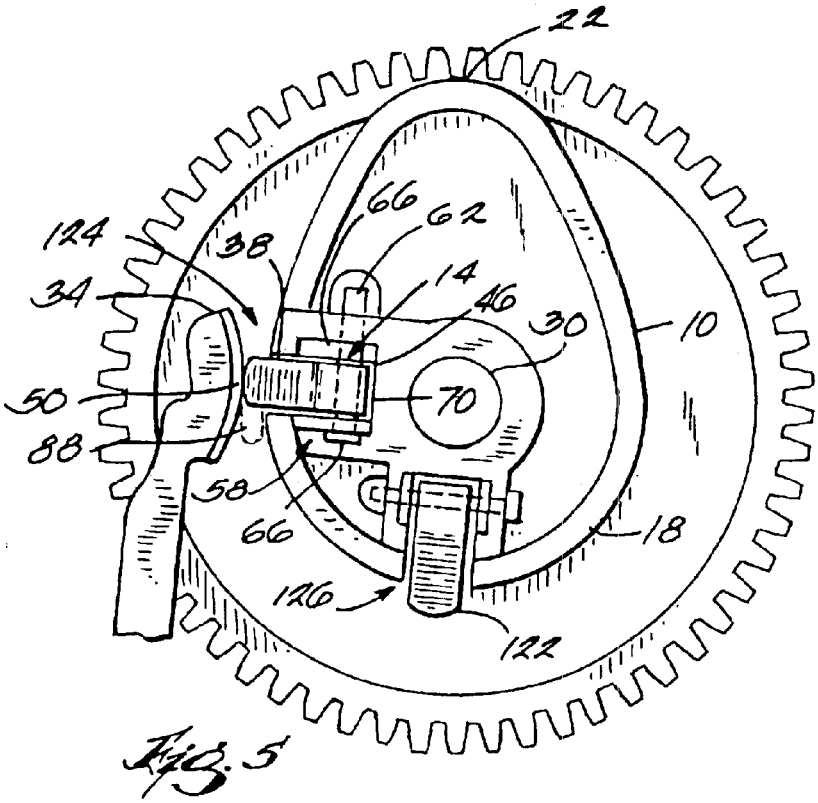
FIG. 5 is a plan view of the cam of FIG. 1.
Figure 6:
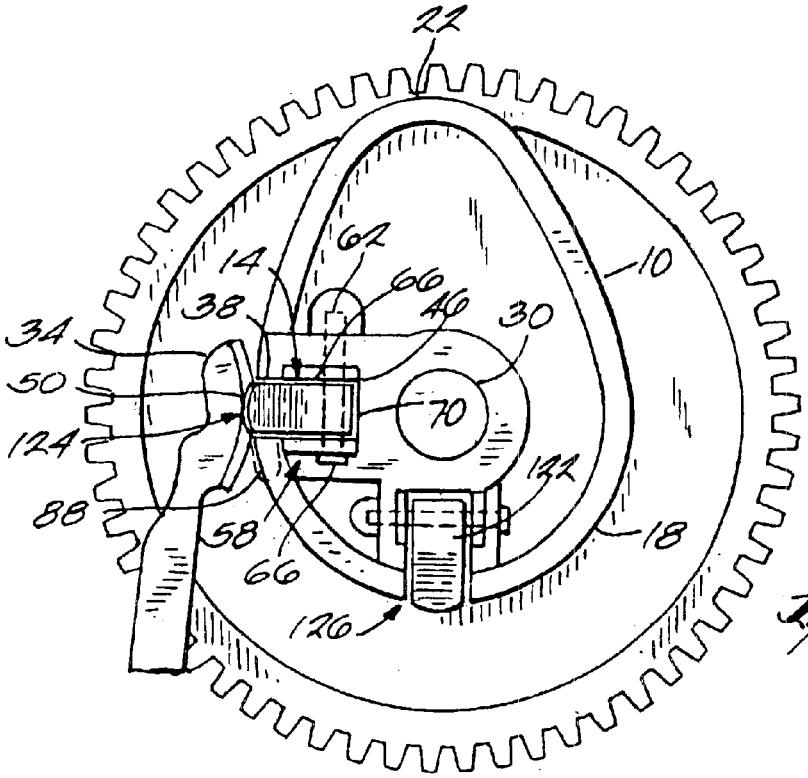
FIG. 6 is a plan view of the cam of FIG. 3.
Figure 14:
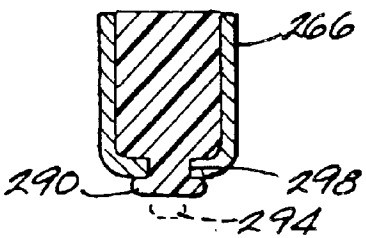
FIG. 14 is a cross-sectional view, taken along line 14—14 of FIG. 9.
Figure 15:
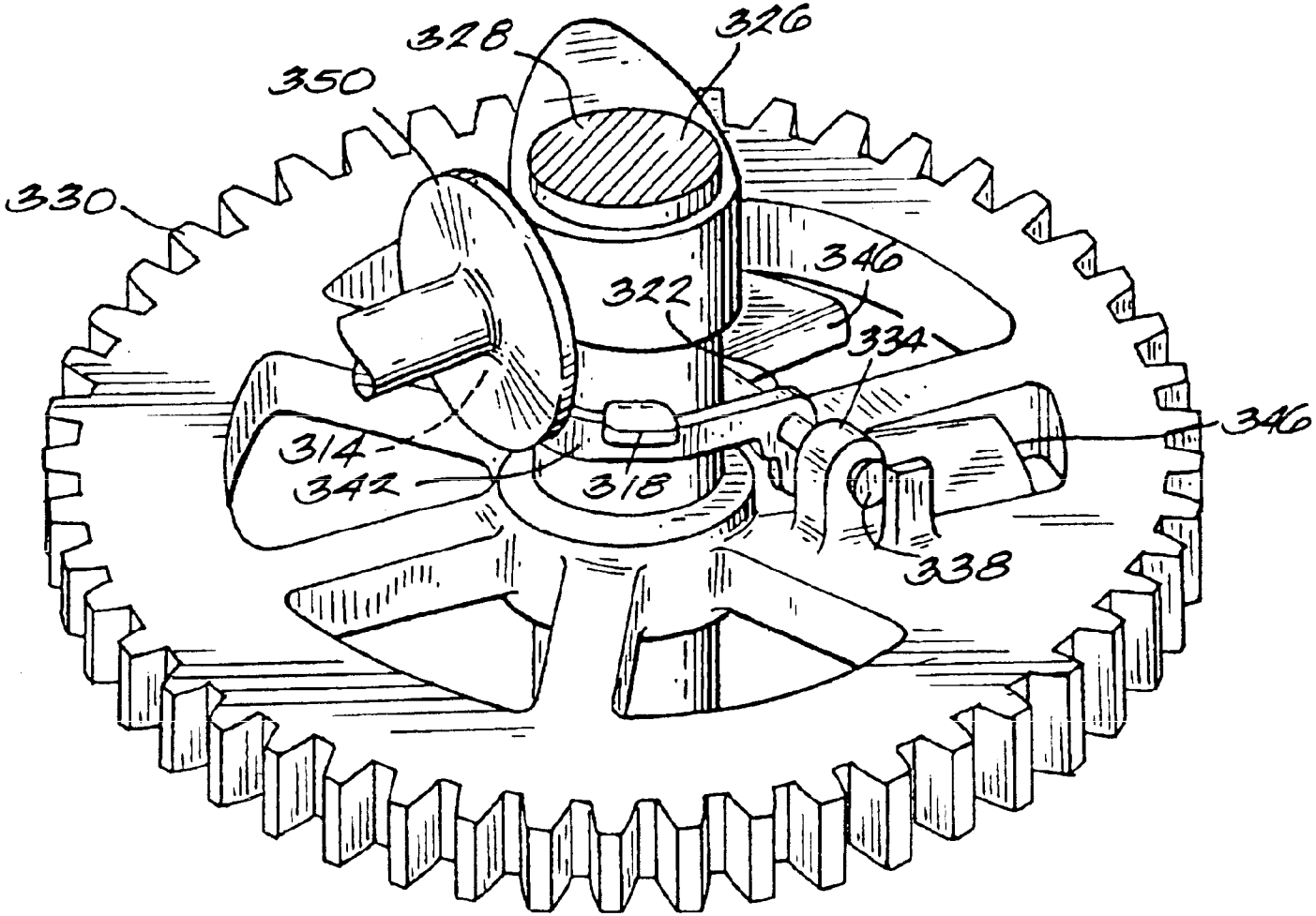
FIG. 15 is a perspective view of a third embodiment of a cam, cam follower, and a vacuum release member.
Figure 16:
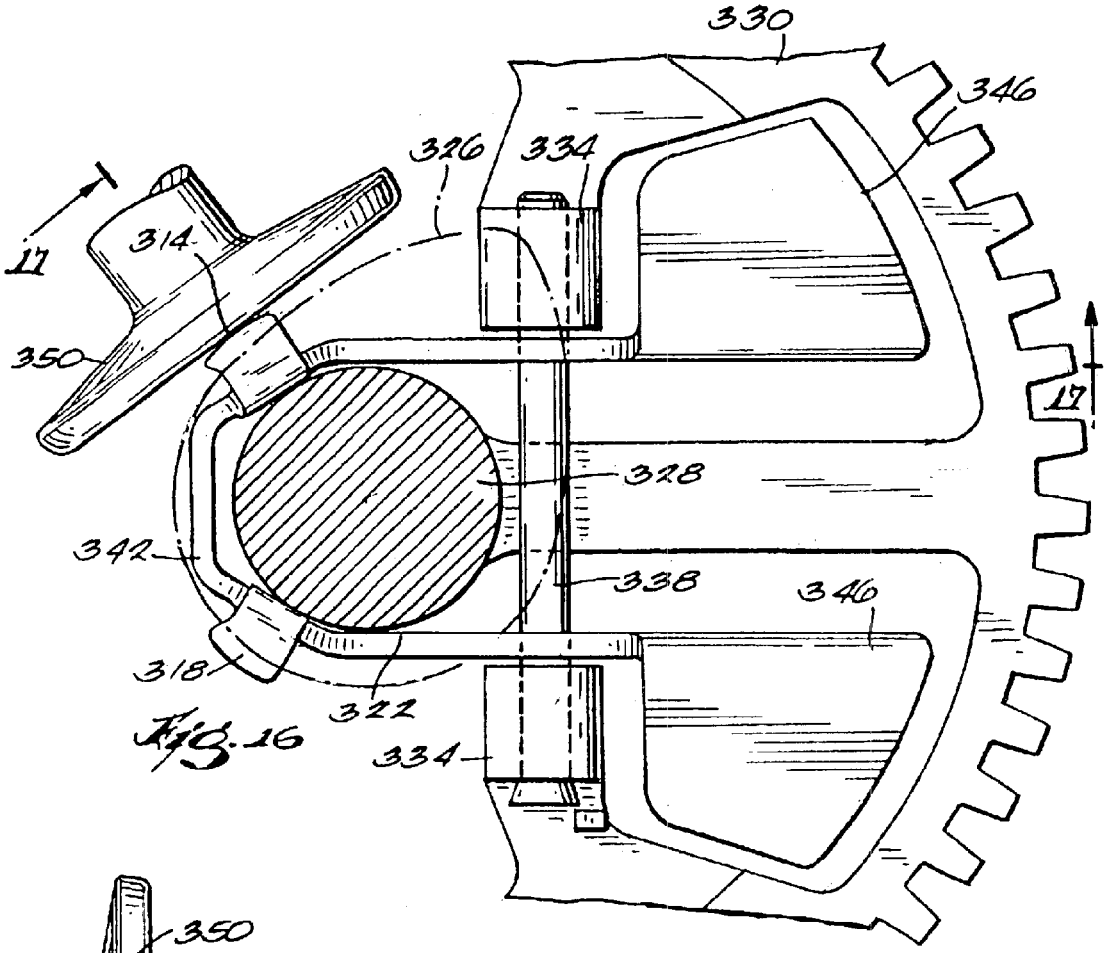
FIG. 16 is a plan view of the vacuum release member of FIG. 15.
Figure 17:
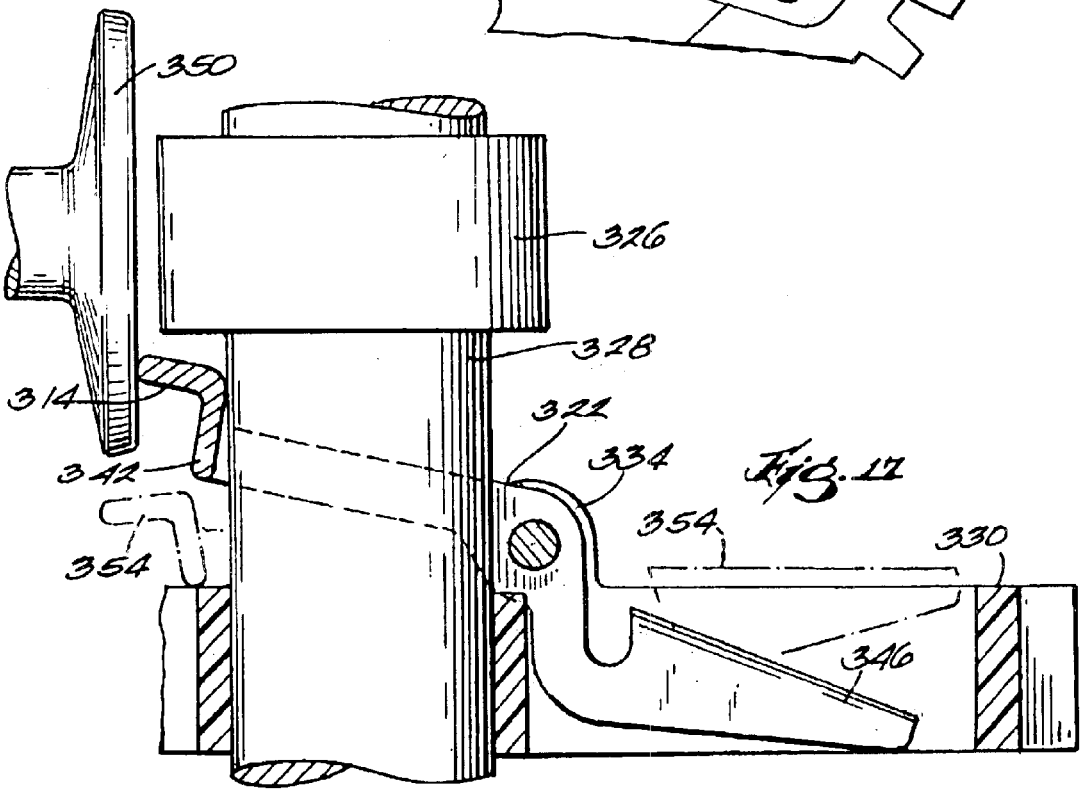
FIG. 17 is a cross-sectional view, taken along line 17—17 of FIG. 16.
Figure 19:
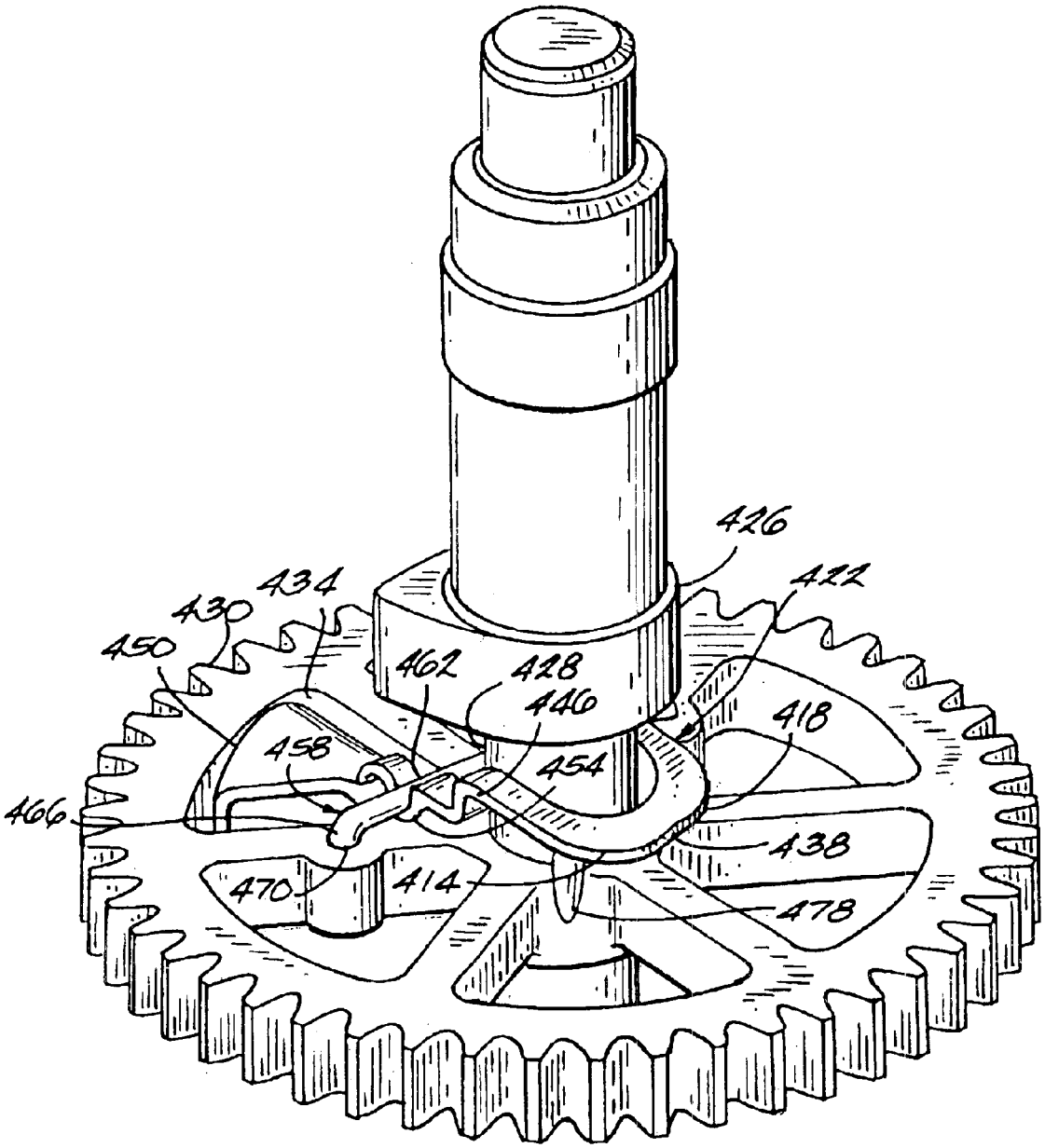
FIG. 19 is a perspective view of a fourth embodiment of a cam, cam follower, and a vacuum release member.
Figure 20:
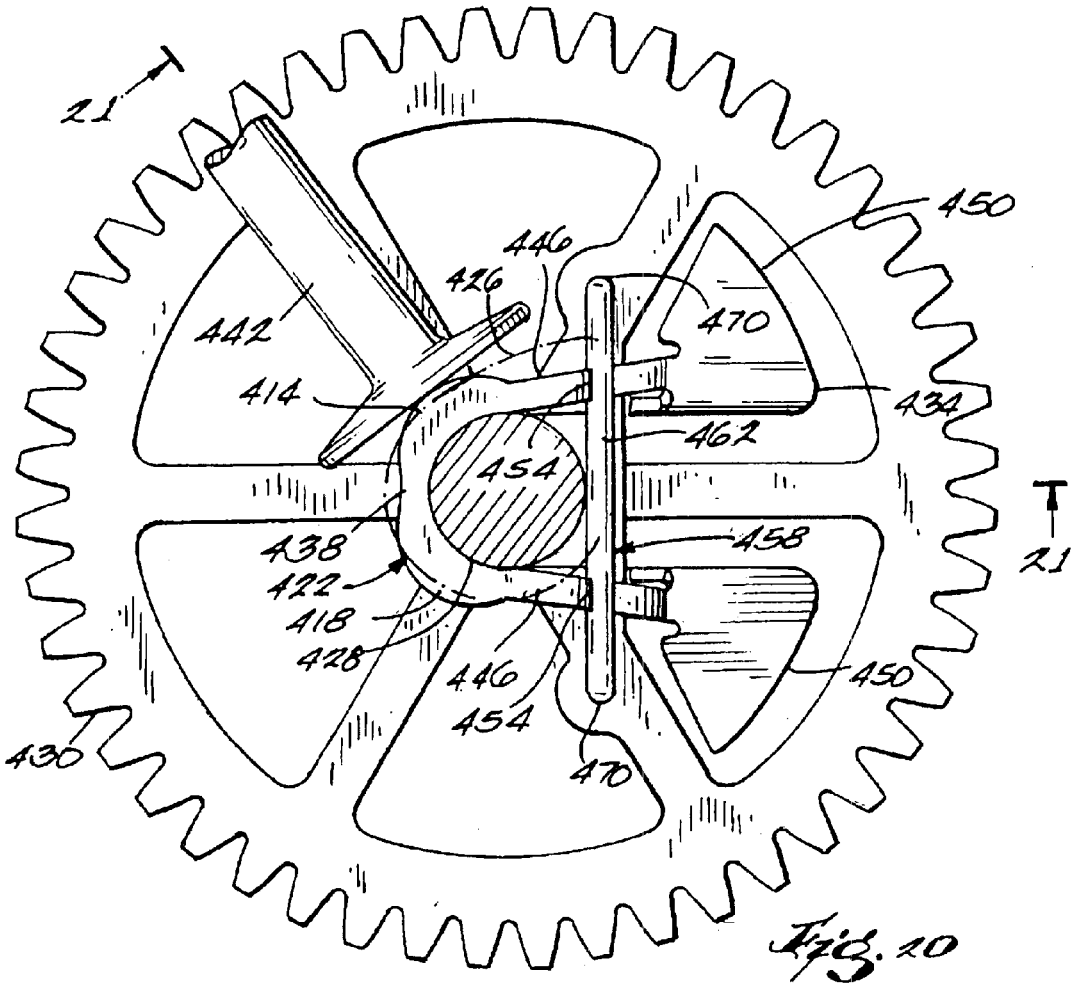
FIG. 20 is a plan view of the vacuum release member of FIG. 19.
Figure 21:
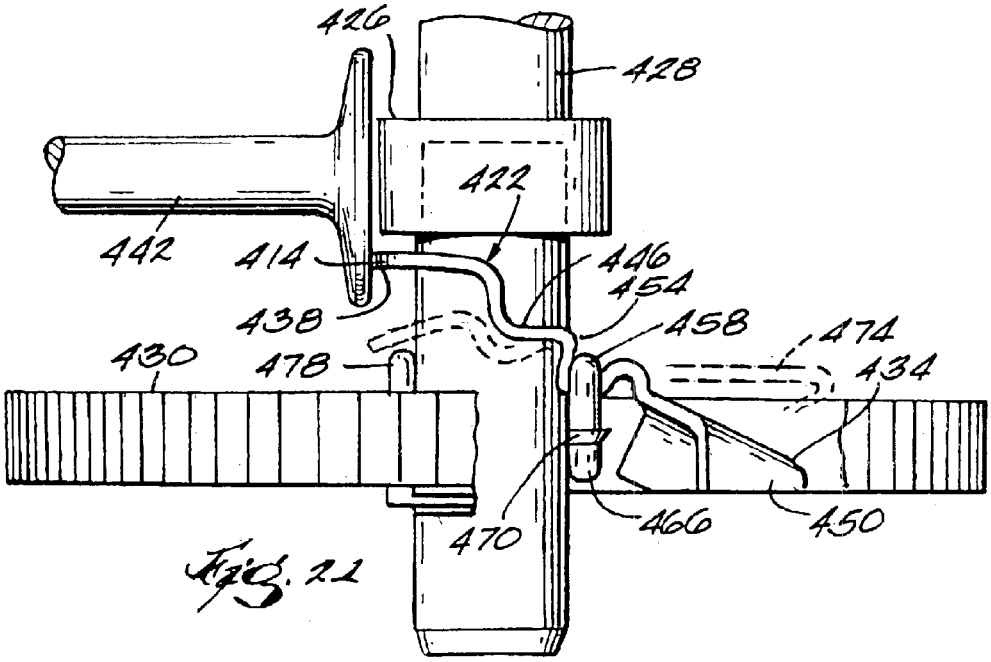
FIG. 21 is a cross-sectional view, taken along line 21—21 of FIG. 20.

Four embodiments of the invention are illustrated in the figures. FIGS. 1–7 illustrate a first embodiment of the invention, FIGS. 8–14 illustrate a second embodiment of the invention, FIGS. 15–17 illustrate a third embodiment of the invention, and FIGS. 19–21 illustrate a fourth embodiment of the invention. In the first embodiment of the invention, as illustrated in FIGS. 1–7, a cam 10 has a centrifugally-responsive vacuum release member 14. The vacuum release member 14 is pivotable between an engaged position, as shown in FIGS. 1, 2 and 5, and a disengaged position, as shown in FIGS. 3, 4 and 6. The cam 10 illustrated in FIGS. 1–6 may be used with an engine 16 (FIG. 7) utilizing a direct lever overhead valve system, as disclosed in U.S. patent application Ser. No. 09/507,070 filed Feb. 18, 2000, which is incorporated herein by reference. The cam 10 has a base radius 18, a cam lobe 22, and a side face 26, and rotates about a cam shaft 30. A cam follower 34 is spring biased to contact the side face 26 of the cam 10 as the cam 10 rotates. The cam follower 34 does not rotate with the cam 10 in relation to the cam shaft 30. The cam lobe 22 extends further from the cam shaft 30 than the base radius 18.

The vacuum release member 14 is centrifugally responsive, and is pivotably retained to the cam 10 to pivot between an engaged position (shown in FIGS. 1, 2 and 5) and a disengaged position (shown in FIGS. 3, 4 and 6). As shown in FIGS. 1, 2 and 5, the vacuum release member 14 is in the engaged position, and extends beyond the base radius 18 to separate the cam follower 34 from the cam 10.

The vacuum release member 14 is substantially L-shaped, and has an engaging portion 38 and a flyweight portion 42 that each extend outward from a bridging portion 46. The bridging portion 46 is substantially U-shaped, and interconnects the engaging portion 38 and the flyweight portion 42. The engaging portion 38 is a relatively flat segment having a cam surface 50 disposed at an end of the engaging portion 38 opposite the bridging portion 46. The cam surface 50 extends beyond the cam 10 and engages the cam follower 34 when the vacuum release member 14 is in the engaged position. As shown in the illustrated embodiment, the cam surface 50 and the cam follower 34 are both arc-shaped to provide a smooth transition for the cam follower 34 between the cam 10 and the cam surface 50. The smooth curved surfaces of the cam follower 34 and cam surface 50 reduce the wear and extend the life of the parts.

The flyweight portion 42 extends from the end of the bridging portion 46 opposite the engaging portion 38, and has a mass sufficient to pivot the vacuum release member 14 in response to engine speed. As illustrated in FIGS. 2 and 4, the flyweight portion 42 is larger than the engaging portion 38. However, the size of the portions 38, 42 may be varied depending on the desired kick-out speed of the vacuum release member 14, as discussed below. A curved end 54 is disposed at the end of the flyweight portion 42 opposite the bridging portion 46, and bends to face back toward the bridging portion 46. The curved end 54 concentrates mass near the end of the flyweight portion 42, and shifts the center of gravity of the vacuum release member 14 toward the flyweight portion 42. The increased mass and shifted center of gravity lowers the kick-out speed and causes the vacuum release member 14 to pivot to the disengaged position at a lower engine speed than if the flyweight portion 42 was the same size as the engaging portion 38.

The size and mass of the flyweight portion 42 may be modified to achieve a desired center of gravity and alter the kick-out speed, causing the vacuum release member 14 to pivot to the disengaged position at a desired speed. The vacuum release member 14 is preferably made from stamped metal and is bent into a desired shape, or is cut and bent from a metal roll. The stamping and bending process for manufacturing the vacuum release member 14 is relatively inexpensive. Bending the curved end 54 provides sufficient clearance for the flyweight portion 42 and concentrates the mass near the curved end 54 to shift the center of gravity. Alternatively, the vacuum release member 14 can be made from powdered metal, or another similar metal forming process, and the thickness or composition of the vacuum release member 14 can be modified to obtain a desired center of gravity. The flyweight portion 42 can also be made from a material having a higher density than the engaging portion 38. In a multi-density embodiment, the flyweight portion 42 and engaging portion 38 may be similar in size, but because of the higher density material, the flyweight portion 42 can still have a greater mass than the engaging portion 38.

In the illustrated embodiments, the cam 10 has a slot 58 that is partially formed in the base radius 18, and extends radially inward toward the cam shaft 30. The vacuum release member 14 is disposed within the slot 58, and is pivotably retained by a pivot pin 62. The pivot pin 62 is partially disposed within the curved bridging portion 46, and the vacuum release member 14 is free to pivot about the pivot pin 62. The slot 58 has two side walls 66 and a back surface 70. The pivot pin 62 preferably extends between the side walls 66.

A shoulder 74 is disposed near the intersection of the slot 58 and the base radius 18. When the vacuum release member 14 is in the engaged position, as shown in FIG. 2, the engaging portion 38 contacts the shoulder 74, and the shoulder 74 provides support for the vacuum release member 14. In a vertical shaft engine, gravity biases the vacuum release member 14 toward the engaged position and a return spring is not necessary. A return spring may be needed in a non-vertical shaft engine embodiment to bias the vacuum release member 14 toward the engaged position.

As mentioned above, the cam follower 34 is spring biased to contact the cam 10. When the vacuum release member 14 separates the cam follower 34 from the cam 10, the spring biased cam follower 34 exerts a force on the vacuum release member 14. Most of the force exerted on the vacuum release member 14 by the cam follower 34 is transferred to the back surface 70, and is not absorbed by the pivot pin 62. The bridging portion 46 contacts the back surface 70, which buttresses the vacuum release member 14 and absorbs most of the force the cam follower 34 applies on the vacuum release member 14. This embodiment preferably does not apply large shear stresses on the pivot pin 62, and may extend the life of the pivot pin 62.

Figure 7:
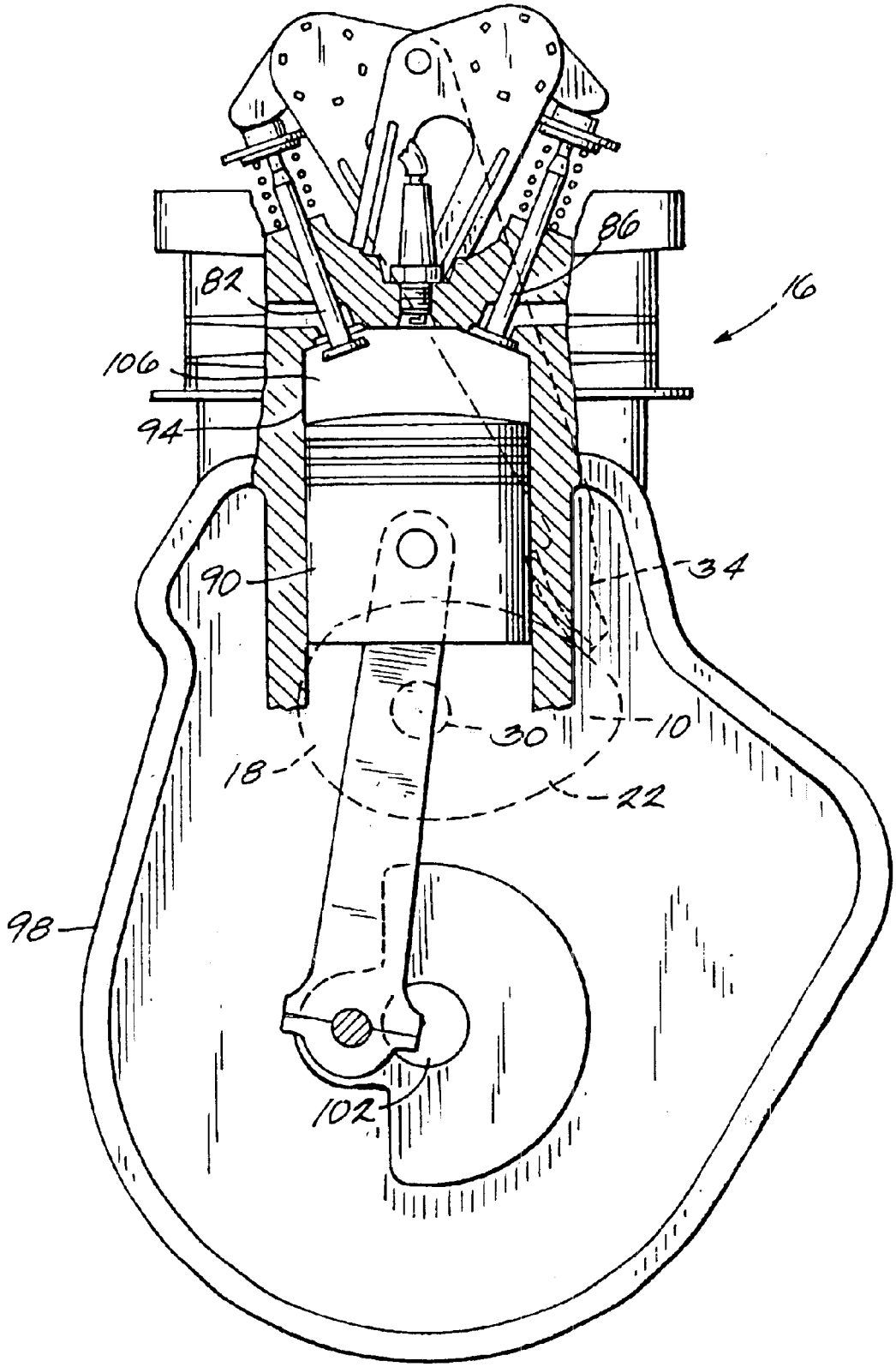
FIG. 7 is a cut-away view of an engine cylinder and piston.

The cam 10 and vacuum release member 14 rotate about the cam shaft 30, and the cam follower 34 contacts the cam 10 as the cam 10 rotates. As shown in FIG. 7, the cam follower 34 is interconnected to an engine valve, although they could be separate components. The term "engine valve" may refer to an exhaust valve 82, an intake valve 86, or both. The vacuum release member 14 preferably affects movement of the exhaust valve 82, but the vacuum release member 14 can alternatively be used to affect the movement of the intake valve 86. The greater the distance the cam follower 34 moves away from the cam shaft 30, the more the cam follower 34 opens the respective engine valve 82 or 86. The cam follower 34 is moved a greater distance from the cam shaft 30 when the cam follower 34 contacts the cam lobe 22, than when the cam follower 34 contacts the base radius 18. In the normal engine cycle, as described below, the cam lobe 22 is timed to contact the cam follower 34 and unseat the exhaust valve 82 during the engine exhaust stroke.

Similarly, as shown in FIGS. 5–6, the cam follower 34 is also moved a greater distance from the cam shaft 30 when the cam follower 34 contacts the cam lobe 22, than when the cam follower 34 contacts the vacuum release member 14. The distance the cam surface 50 extends beyond the base radius 18 determines how far the vacuum release member 14 separates the cam follower 34 from the cam 10, and how far the cam follower 34 opens the respective engine valve 82 or 86 (FIG. 7).

The vacuum release member 14 generally displaces the cam follower 34 a greater distance than the base radius 18 displaces the cam follower 34. In embodiments incorporated into other engines, the cam follower may move toward the cam shaft to open the valve, instead of away. In these embodiments, the cam follower will move closer to the cam shaft when the cam follower contacts the vacuum release member, than when the cam follower contacts the base radius. The cam lobe will displace the cam follower and the valve a greater distance than the vacuum release member.

As shown in FIGS. 5 and 6, the width of the engaging portion 38 determines the amount of time the vacuum release member 14 separates the cam follower 34 from the cam 10. The wider the engaging portion 38 and the cam surface 50, the longer period of time the vacuum release member 14 contacts the cam follower 34 and separates the cam follower 34 from the cam 10. In an alternate embodiment, the engaging portion 38 may have an extension 88 that extends the cam surface 50 in a direction substantially tangential to the cam 10. In FIGS. 5–6, the extension 88 is illustrated in broken lines to show the alternate embodiment. A vacuum release member 14 having the extension 88 would separate the cam follower 34 from the cam 10 for a longer period of time than a vacuum release member 14 without an extension 88, which would thereby open the respective engine valve 82 or 86 (FIG. 7) for a longer period of time. Additional clearance from the slot 58 may be needed to permit the vacuum release member 14 with the extension 88 to pivot between the engaged and disengaged positions.

As shown in FIG. 7, the engine 16 has a reciprocable piston 90 disposed within a cylinder 94 and a crankcase 98. A crankshaft 102 is also disposed within the crankcase 98. Engine valves 82, 86 are disposed near an end of the cylinder 94, and a combustion chamber 106 is disposed between the piston 90 and the engine valves 82, 86. The vacuum release member 14 (FIG. 5) is timed to contact the cam follower 34 and unseat the exhaust valve 82 during the expansion stroke when the piston 90 is moving away from the combustion chamber 106 and toward the crankcase 98. The vacuum release member 14 (FIG. 5) opens the exhaust valve 82 less during the expansion stroke than the cam lobe 22 opens the exhaust valve 82 during the exhaust stroke.

Figure 18:
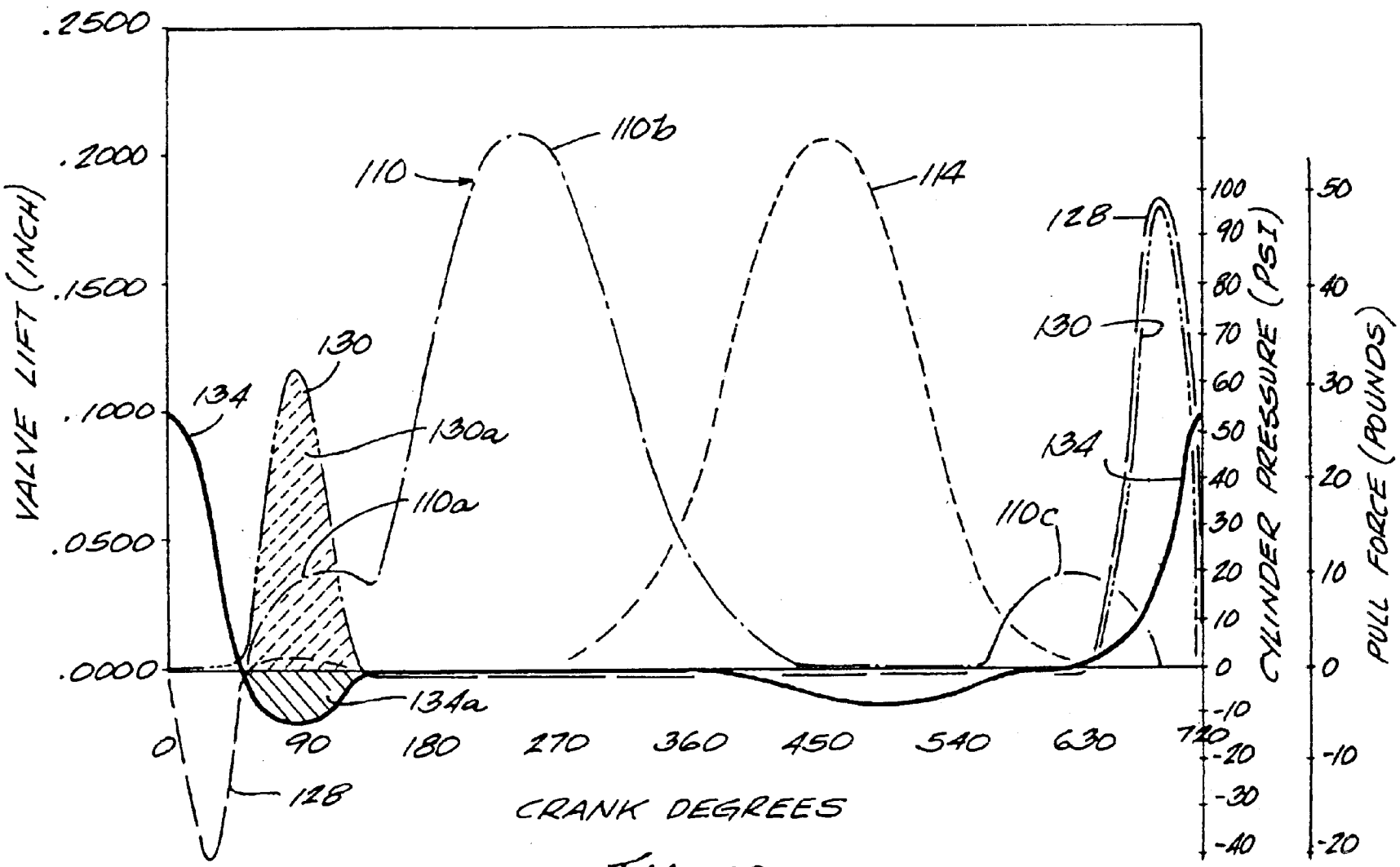
FIG. 18 is a graph depicting engine crank degrees in relation to engine valve lift, resistive force, and combustion chamber pressure.

FIG. 18 illustrates a graph representing the engine valve lift, cylinder pressure, and pull force in relation to the crank degrees of the engine cycle. FIGS. 7 and 18 together illustrate various conditions occurring within the engine 16 during the engine cycle. Engine cycle crank degrees is represented as 720 degrees because the crankshaft 102 completely rotates twice for each engine cycle. 0 degrees to 180 degrees represents the expansion stroke during which the piston 90 is moving away from the combustion chamber 106 and toward the crankcase 98. 180 degrees to 360 degrees represents the exhaust stroke during which the piston 90 is moving away from the crankcase 98 and toward the combustion chamber 106. 360 degrees to 540 degrees represents the intake stroke during which the piston 90 is moving away from the combustion chamber 106 and toward the crankcase 98. 540 degrees to 720 degrees represents the compression stroke during which the piston 90 is moving away from the crankcase 98 and toward the combustion chamber 106.

The valve lift represents the distance in inches that the exhaust valve 82 or the intake valve 86 is moved from each valve's respective seat. The term "lift" should not be construed to mean vertical movement. "Lift" merely refers to the movement of the engine valves, and the movement may be in any direction depending on the orientation of the engine and valves. A lift of 0 represents a closed, or seated, position. As illustrated in FIG. 18, exhaust valve lift 110 illustrates the distance the exhaust valve 82 is moved from its seat while the vacuum release member 14 and compression release member 122 are in the engaged position. The intake valve lift 114 illustrates the distance the intake valve 86 is moved from its seat. The valve lifts 110, 114 graphed in FIG. 18 represent the approximate valve lift for the illustrated embodiment of a 5 hp engine of the direct lever type. The actual valve lift for an engine will greatly depend upon the size and configuration of the engine. Additionally, the engine valves 82, 86 must overcome valve lash when opening, and do not actually open to permit air flow until the valve lift exceeds approximately 0.01 inches.

The exhaust valve 82 is lifted when the cam follower 34 contacts the vacuum release member 14, the cam lobe 22 and the compression release member 122 at various points during the engine cycle. The exhaust valve lift 110 illustrates the distance the exhaust valve 82 is lifted from its seat while the vacuum release member 14 and compression release member 122 are in the engaged position. In FIG. 18, a portion 110*a* of the exhaust valve lift 110 represents the lift due to the vacuum release member 14. A portion 110*b* of the exhaust valve lift 110 represents the lift due to the cam lobe 22. A portion 110*c* represents the lift due to the compression release member 122.

As shown in FIGS. 7 and 18, the cam lobe 22 contacts the cam follower 34 to lift the exhaust valve 82 approximately 0.21 inches at portion 110*b* during the exhaust stroke. Comparatively, the vacuum release member 14 (FIG. 5) contacts the cam follower 34 to lift the exhaust valve 82 approximately 0.04 inches at portion 110*a* during the expansion stroke. As mentioned above, the vacuum release member 14 is normally used in cooperation with a compression release member 122 to reduce the resistive torque during starting. Starting usually involves the operator pulling on a pull cord to rotate the engine through the engine cycle, but starting could also include an electric starter rotating the engine.

A compression release member 122 illustrated in FIGS. 1–6 is disclosed in U.S. patent application Ser. No. 09/782,468 filed Feb. 9, 2001, which is incorporated herein by reference. A mechanical vacuum release ("MVR") 124 refers to the entire mechanism that relieves the vacuum created in the combustion chamber 106 during a non-combusting expansion stroke. The MVR 124 comprises the vacuum release member 14, the cam follower 34, and the exhaust valve 82. A mechanical compression release ("MCR") 126 refers to the entire mechanism that relieves the pressure in the combustion chamber 106 during a compression stroke. The MCR 126 comprises the compression release member 122, the cam follower 34, and the exhaust valve 82.

The compression release member 122 contacts the cam follower 34 to lift the exhaust valve 82 during the compression stroke to relieve pressure in the combustion chamber 106 by allowing air to exit the combustion chamber 106 through the exhaust valve 82. The combustion chamber 106 is substantially airtight when the engine valves 82, 86 are closed. Therefore, releasing air from the combustion chamber 106 during the compression stroke creates a vacuum in the combustion chamber 106 during the expansion stroke. The primary reason the vacuum condition exists is because the pressure within the combustion chamber 106 was released by the compression release member 122. The vacuum release member 14 contacts the cam follower 34 to lift, or unseat, the exhaust valve 82 during the expansion stroke to relieve the vacuum in the combustion chamber 106 by allowing air to enter the combustion chamber 106 through the exhaust valve 82.

As illustrated by the exhaust valve lift 110 in FIGS. 7 and 18, the vacuum release member 14 preferably first contacts the cam follower 34 to lift the exhaust valve 82 at approximately 40 crank degrees. The vacuum release member 14 could possibly begin to open the exhaust valve 82 between 0 and 90 crank degrees, and the preferred range for beginning to open the exhaust valve 82 is between 30 and 70 crank degrees. The expansion stroke occurs between 0–180 crank degrees, but a large portion of the work from the expansion stroke is done between 0–120 crank degrees. Therefore, the engine 16 may lose too much power and may not properly accelerate if the vacuum release member 14 begins to open the exhaust valve 82 too early.

The vacuum release member 14 contacts the cam follower 34 and the exhaust valve 82 is preferably opened approximately 0.04 inches at about 100 crank degrees, as shown by portion 110*a*, during the expansion stroke. The exhaust valve 82 begins to close before the cam lobe 22 contacts the cam follower 34 to open the exhaust valve 82 for the exhaust stroke. The exhaust valve 82 is opened approximately 0.21 inches at about 255 crank degrees, as shown by portion 110*b*, and the exhaust valve 82 then returns to a closed position for the intake stroke at approximately 450 crank degrees. The compression release mechanism 122 first contacts the cam follower 34 to open the exhaust valve 82 during the compression stroke at approximately 550 crank degrees. The exhaust valve 82 is opened approximately 0.04 inches at about 610 crank degrees, as shown by portion 110*c*, and the exhaust valve 82 then returns to a closed position at approximately 670 crank degrees.

Once the compression stroke ends at 720 degrees, the expansion stroke begins again at 0 degrees. In FIG. 18, 720 degrees and 0 degrees refer to the same point, which may also be referred to as top-dead-center, since it represents the point where the piston 90 is at the end of its stroke near the engine valves 82, 86. At 720 or 0 degrees, or top-dead-center, the piston 90 changes directions, and the compression stroke transitions into the expansion stroke.

As mentioned above, the MCR 126 preferably opens, as shown by exhaust valve lift 110, at approximately 550 degrees, and closes at approximately 670 degrees. Also, the MVR 124 preferably opens at approximately 40 degrees, and begins to close near 135 degrees. The points where the MCR 126 closes and MVR 124 opens are more significant than where the MCR 126 opens and the MVR 124 closes. In the illustrated embodiment, the MCR 126 closes near 670 degrees, and the MVR 124 opens near 40. Therefore, the exhaust valve 82 is closed for approximately 90 crank degrees between the MCR 126 and the MVR 124, and the exhaust valve 82 is closed at top-dead-center.

As mentioned above, if the MVR 124 opens too early, the engine 16 may lose too much power and may not properly accelerate. Similarly, the engine 16 may not be able to accelerate if the MCR 126 closes too late. Even when the MVR 124 and MCR 126 are engaged, the engine 16 must retain and begin to compress some of the air/fuel mixture for combustion to accelerate the engine speed. Therefore, the exhaust valve 82 must remain substantially closed when the engine is at 720 degrees, or top-dead-center, so that the engine 16 can eventually accelerate to normal operating speeds, which will disengage the MVR 124 and MCR 126, as described below.

In the illustrated embodiment, the exhaust valve 82 is closed for approximately 90 crank degrees, which includes 720 degrees, or top-dead-center. The exhaust valve 82 must be closed at 720 degrees, and the engine could possibly operate as long as the MCR 126 closes far enough before 720 degrees, and the MVR 124 opens far enough after 720 degrees to permit some combustion and work transfer to the crankshaft 102 to occur. Preferably, the exhaust valve 82 is closed for at least 40 crank degrees between the MCR 126 and MVR 124, including 720 degrees.

All of the degrees referred to above have been crank degrees representing crankshaft 102 rotation. As mentioned above, crank degrees goes up to 720 degrees because the crankshaft 102 completely rotates twice for every engine cycle. However, the cam shaft 30 only completely rotates once for every engine cycle, so cam degrees representing cam shaft 30 rotation only goes up to 360 cam degrees. Cam degrees are generally one-half of the corresponding crank degrees.

As shown in FIG. 18 and mentioned above, the maximum for the MVR 124 is approximately 100 crank degrees, and the maximum for the MCR 126 is approximately 610 crank degrees. The maximums are separated by approximately 210 crank degrees. Converted from crank degrees into cam degrees, the maximums are separated by approximately 105 cam degrees. The maximums may represent the centerlines of the vacuum release member 14 and the compression release member 122.

As illustrated in FIGS. 5 and 6, the centerlines of the vacuum release member 14 and the compression release member 122 are spaced approximately 105 cam degrees apart in relation to the cam shaft 30. The specific degree of separation between the centerlines is not necessary, and the centerlines could be modified by either opening the MCR 126 earlier, or closing the MVR 124 later. As mentioned above, the point where the MCR 126 opens and the MVR 124 closes is not as significant as where the MCR 126 closes and MVR 124 opens. Therefore, since the separation of the centerlines may be easily modified by adjusting non-critical features, the separation between the centerlines could be increased above 105 cam degrees. Additionally, the centerlines of the engaging portion 38, cam surface 18 and the cam follower 34 may be offset, and need not be aligned with one another. However, as mentioned above, the exhaust valve 82 must close between the MCR 126 closing and the MVR 124 opening, and the exhaust valve 82 is preferably closed for 40 crank degrees, or 20 cam degrees. Therefore, the vacuum release member 14 and the compression release 122 are preferably spaced far enough apart to allow the cam follower 34 to contact the cam 10, and to allow the exhaust valve 82 to close between the MCR 126 and the MVR 124.

The vacuum release member 14 and the compression release member 122 only contact the cam follower 34 to lift the exhaust valve 82 while the members 14, 122 are in the engaged position. As mentioned above, the vacuum release member 14 is in the engaged position (FIGS. 1, 2 and 5) as the engine is started. As the engine speed increases and reaches normal operating speeds, the rotation speed of the cam 10 and vacuum release member 14 about the cam shaft 30 also increases. Once the engine speed reaches a predetermined kick-out speed, the flyweight portion 42 is centrifugally forced away from the cam shaft 30, causing the vacuum release member 14 to pivot about the pivot pin 62 and move into the disengaged position (FIGS. 3, 4 and 6). As the vacuum release member 14 pivots into the disengaged position, the engaging portion 38 is moved away from the shoulder 74 and out of contact from the cam follower 34. Once the vacuum release member 14 is disengaged, the cam follower 34 preferably contacts the cam 10 throughout the entire rotation of the cam 10, and the engine valves 82, 86 operate normally.

As mentioned above, the vacuum release member 14 is in the engaged position (FIGS. 1, 2 and 5) for engine starting speeds, and pivots to the disengaged position (FIGS. 3, 4 and 6) when the engine reaches normal operating speeds. The kick-out speed generally occurs during the transition between starting speeds and normal operating speeds. The purpose of the vacuum release member 14 is to reduce resistance during the starting event, and it is only desirable for the vacuum release member 14 to be engaged during engine starting speeds. A person pulling on a pull cord to start an engine generally rotates the engine approximately 350–700 RPM, with the average usually being between approximately 500–600 RPM. The desired range for the kick-out speed for the vacuum release member 14 is approximately 200–600 RPM. The kick-out speed could be below 200 RPM, but the vacuum release member 14 would not work as effectively. Also, the kick-out speed could be above 600 RPM, but the engine begins to lose too much power if the vacuum release member 14 remains engaged at too high of a speed.

Since the vacuum release member 14 is normally used in cooperation with the compression release member 122, the vacuum release member 14 should preferably not remain engaged after the compression release member 122 has disengaged. The kick-out speed for the vacuum release member 14 is preferably less than, or similar to the kick-out speed for the compression release member 122. In the illustrated embodiment, the flyweight portion 42 of the vacuum release member 14 is larger than the corresponding flyweight of the compression release member 122. The relatively large flyweight portion 42 generally causes the vacuum release member 14 of the illustrated embodiment to disengage at a lower speed than the compression release member 122. If the vacuum release member 14 and the compression release member 122 were desired to disengage at approximately the same speed, then the shape of the members 14, 122 could also be approximately the same.

The MVR 124 and the MCR 126 are intended to reduce the resistive engine torque, or resistive force, on the pull cord ("pull force") during starting. FIG. 18 illustrates the pull force in pounds in relation to crank degrees for an engine. A dual release line 128 represents the pull force for an engine having both a MCR 126 and a MVR 124. A single release line 130 represents the pull force for an engine having only a MCR 126, but not a MVR 124. The single release line 130 provides a comparative illustration of the additional pull force for an engine without a MVR 124, and therefore also illustrates the pull force reduced by the MVR 124. The single release line 130 has a peak near 90 degrees that is not present on the dual release line 128, and this peak near 90 degrees represents the pull force reduced by the MVR 124. A shaded area 130*a* under the single release line 130 represents the energy reduction by using the MVR 124.

As mentioned above, the MVR 124 is only needed when a MCR 126 is used, and the pull force reduced by the MCR 126 is significantly larger than the pull force reduced by the MVR 124. The pull force for an engine without a MCR 126 would be off the scale of FIG. 18.

A pressure line 134 represents the pressure in psi within the combustion chamber 106 during the starting event for an engine having only a MCR 126. When the engine valves 82, 86 are both closed, the combustion chamber 106 has a substantially air-tight seal. The pressure line 134 may fluctuate as the movement of the piston 90 increases or decreases the volume of the combustion chamber 106, because the change of volume of the substantially sealed combustion chamber 106 will also change the pressure within the combustion chamber 106. For most of the engine cycle illustrated in FIG. 18, the pressure line 134 is near zero, which indicates that one of the engine valves 82, 82 are open and the combustion chamber 106 is vented. The pressure line 134 becomes slightly negative (meaning a vacuum) near 500 crank degrees as the piston 90 moves away from the combustion chamber 106 during the intake stroke to draw the air/fuel mixture into the combustion chamber 106 through the open intake valve 86.

In the illustrated embodiment, the MCR 126 begins closing the exhaust valve 82 at approximately 630 crank degrees, and the exhaust line 110*c* begins decreasing. At this same time, the piston 90 is moving toward the combustion chamber 106 during the compression stroke to decrease the volume of the combustion chamber 106. The combination of the exhaust valve 82 closing and the volume of the combustion chamber 106 decreasing causes the pressure within the combustion chamber 106 to increase, so the pressure line 134 begins increasing near 630 crank degrees. As the pressure line 134 increases, the pull force required to continue moving the piston 90 toward the combustion chamber 106 also increases, so the dual release line 128 also begins increasing near 630 crank degrees.

The pressure line 134 continues increasing after the exhaust valve 82 closes because the piston 90 continues moving toward the combustion chamber 106 to decrease the volume of the combustion chamber 106 after the combustion chamber 106 is resealed. Once the piston 90 passes top-dead-center at 720 or 0 crank degrees, the pressure built-up within the combustion chamber 106 pushes the piston 90 downward and actually creates a negative force on the pull cord, as shown by the dual release line 128 which decreases below zero immediately after 0 degrees.

As described above, the pressure line 134 represents the pressure for an engine having only a MCR 126. In an engine having only a MCR 126, the pressure line 134 becomes negative (meaning a vacuum) as the piston 90 continues moving away from the combustion chamber 106 and toward the crankcase 106 because a portion of the air within the combustion chamber 106 was released through the exhaust valve 82. The volume of the combustion chamber 106 continues to increase, but there is no new air available to fill this volume so a vacuum is created.

In an engine having both a MCR 126 and a MVR 124, the MVR 124 unseats the exhaust valve 82 during the expansion stroke and air is drawn into the combustion chamber 106 to minimize the vacuum otherwise created by the MCR 126. The exhaust line 110*a* begins increasing near 40 crank degrees as the MVR 124 begins opening the exhaust valve 82. A shaded area 134*a* above the pressure line 134 near 90 crank degrees represents the vacuum created by the MCR 126. The MVR 124 reduces vacuum represented by the shaded area 134*a* to near zero. Since the vacuum is reduced by the MVR 124, the dual release line 128 also remains near zero at approximately 90 crank degrees. As described above, the single release line 130 increases near 90 crank degrees because additional pull force is needed to overcome the vacuum 134*a* created by the MCR 126. The MVR 124 reduces the vacuum 134*a*, and thereby reduces the energy 130*a* needed to overcome the vacuum.

As mentioned above, FIGS. 1–6 illustrate the first embodiment of the invention incorporated into an engine utilizing a direct lever overhead valve system. FIGS. 8–14 illustrate a second embodiment of the invention that implements a centrifugally responsive vacuum release mechanism 214 in a different engine configuration. The second embodiment of the invention also relieves a vacuum within the combustion chamber during the expansion stroke when the engine is rotating at cranking and starting speeds.

In the second embodiment, a cam 218 rotates with a cam shaft 222, and contacts a tappet-type cam follower 226 which controls an engine valve 230. The vacuum release mechanism 214 is disposed near the cam 218, and comprises a blocking member 234 and a cantilevered beam 238. A cam surface 258 on the beam 238 acts as the vacuum release member.

Figure 8:
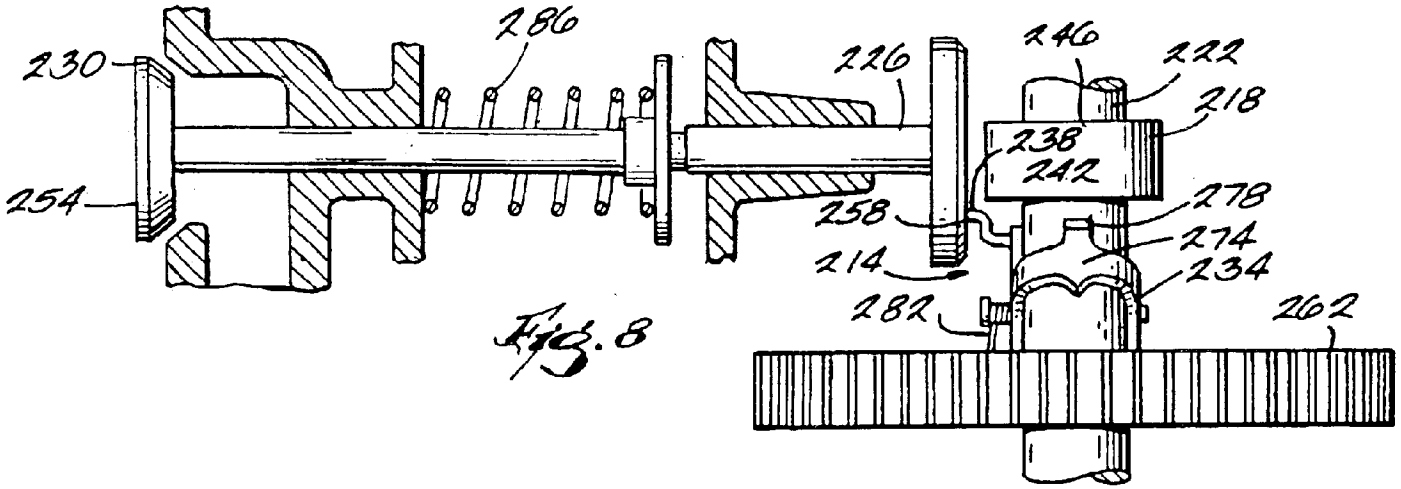
FIG. 8 is a plan view of a second embodiment of a cam and cam follower with a vacuum release member in an engaged position, and a partial cross-sectional view of an engine valve train.
Figure 9:
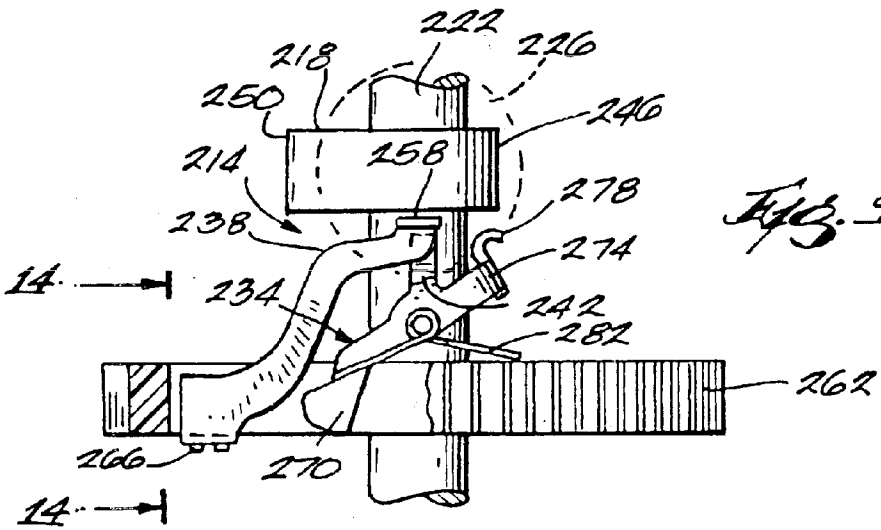
FIG. 9 is a plan view of the vacuum release member of FIG. 8.
Figure 10:
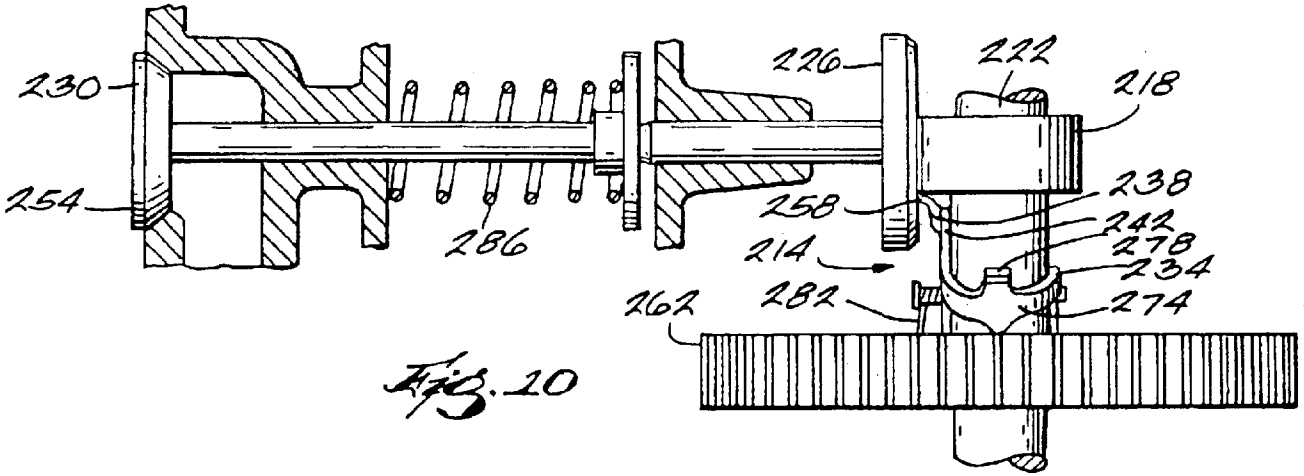
FIG. 10 is a plan view of a second embodiment of a cam and cam follower with a vacuum release member in a disengaged position, and a partial cross-sectional view of an engine valve train.
Figure 11:
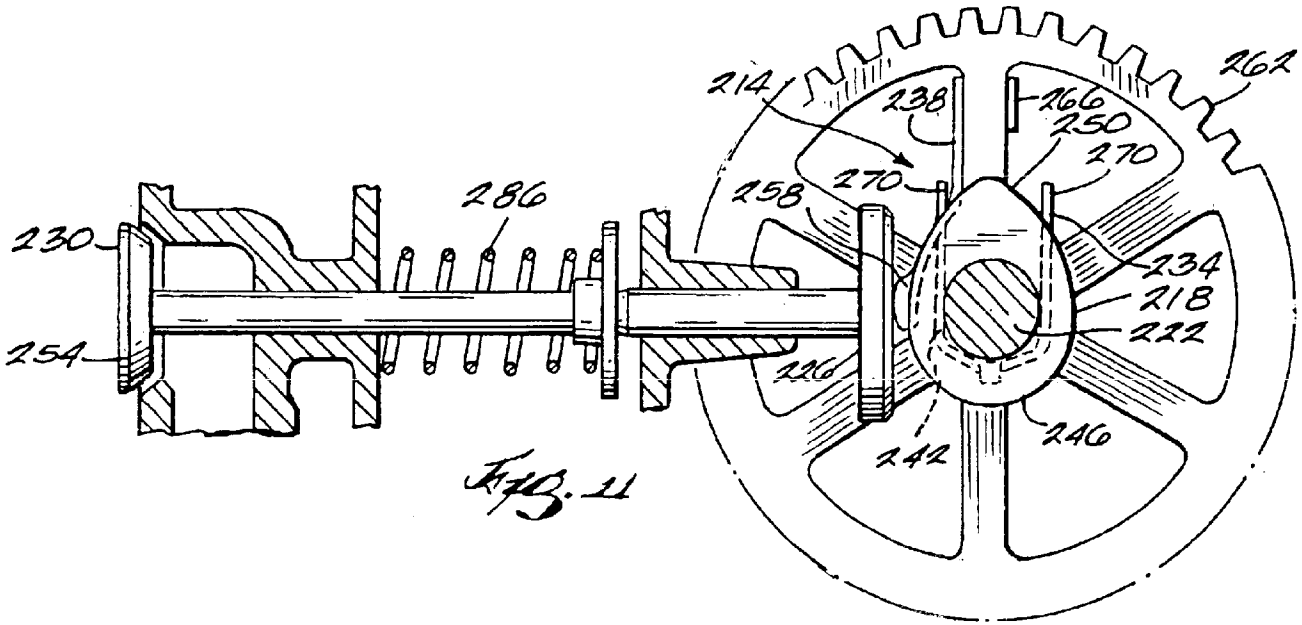
FIG. 11 is a plan view of the vacuum release member of FIG. 8.
Figure 12:
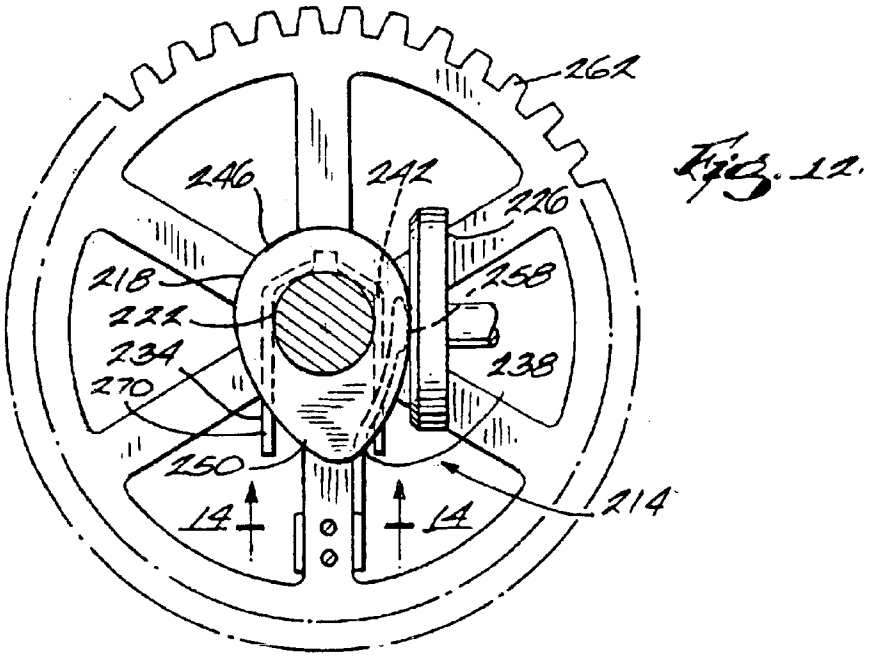
FIG. 12 is a plan view of the vacuum release member of FIG. 10.
Figure 13:
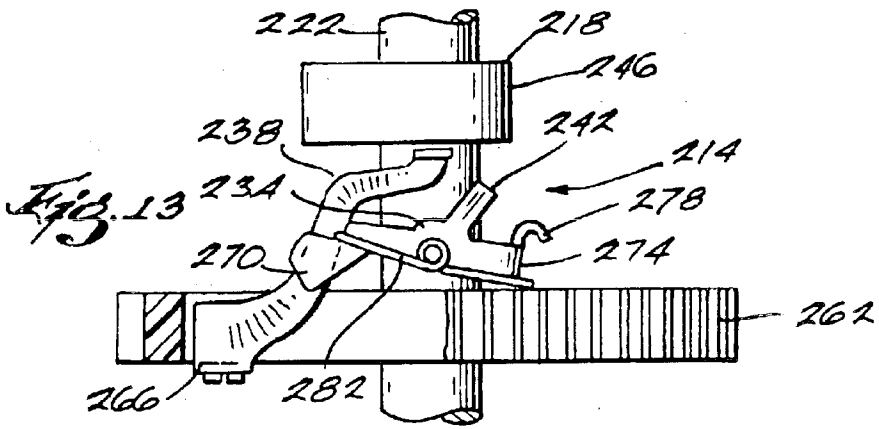
FIG. 13 is a plan view of the vacuum release member of FIG. 10.

Similar to the first embodiment, the second embodiment also has an engaged position, as shown in FIGS. 8, 9 and 11, and a disengaged position, as shown in FIGS. 10, 12 and 13. As illustrated in FIGS. 8, 9 and 11, the blocking member 234 has a tab 242 that is disposed between the cantilevered beam 238 and the cam shaft 222 when the vacuum release mechanism 214 is in the engaged position. In FIG. 11, the cam 218 has a base radius 246 and a cam lobe 250. The base radius 246 is a portion of the cam 218 that extends a substantially uniform distance from the cam shaft 222. The cam lobe 250 is a bulge that extends outward from the cam shaft 222 beyond the base radius 246. The cam follower 226 is interconnected to the engine valve 230, and contacts the cam 218 as the cam 218 rotates. The cam follower 226 preferably opens the engine valve 230 when the cam lobe 250 contacts the cam follower 226. The engine valve 230 is preferably an exhaust valve 254, but it could possibly be an intake valve. The engine valve 230 is configured to be closed when the cam follower 226 contacts the base radius 246. The cam lobe 250 is preferably timed to contact the cam follower 226 and open the exhaust valve 230 during the exhaust stroke of the engine.

The cantilevered beam 238 has a cam surface 258 that is disposed near the end of the cantilevered beam 238 adjacent the cam 218. The cantilevered beam 238 is interconnected to a cam gear 262, and has a bracket 266 at the end of the cantilevered beam 238 opposite the cam surface 258. The cam gear 262 rotates the cam in timed relation to the engine crankshaft. When the vacuum release mechanism 214 is in the engaged position (FIGS. 8, 9 and 11), the cam surface 258 extends beyond the base radius 246 and separates the cam follower 226 from the cam 218 to open, or unseat, the engine valve 230. The vacuum release mechanism 214 preferably opens the engine valve 230 less during the expansion stroke than the cam lobe 250 opens the engine valve 230 during the exhaust stroke. The vacuum release mechanism 214 is preferably timed to contact the cam follower 226 and open the engine valve 230 during the expansion stroke of the engine.

In the illustrated embodiment, the blocking member 234 is substantially U-shaped, and has respective flyweight portions 270 near the two ends of the U-shape. The blocking member 234 is pivotably coupled to the cam shaft 222, and may pivot between the engaged position (FIGS. 8, 9 and 11) and the disengaged position (FIGS. 10, 12 and 13). As mentioned above, the vacuum release mechanism 214 is normally used in cooperation with a compression release member 274 to reduce the resistive torque during starting. In the second embodiment, the blocking member 234 may also function as the compression release member 274, similar to the saddle or yoke-type compression release member disclosed in U.S. Pat. No. 4,453,507, which is incorporated herein by reference.

A cam member 278 is disposed near the curved portion of the blocking member 234, and extends away from the cam shaft 222 and beyond the base radius 246. The cam member 278 may form a portion of the compression release member 274 and contact the cam follower 278 to separate the cam follower 278 from the cam 218. The cam member 278 is preferably timed to contact the cam follower 226 and open the engine valve 230 during the compression stroke when the blocking member 234 is in the engaged position. A return spring 282 may be used to bias the blocking member 234 toward the engaged position, and the blocking member 234 preferably remains in the engaged position when the engine is rotating at or below starting speeds.

As the engine and cam shaft 222 begin to rotate faster, the blocking member 234 also rotates faster, and the flyweight portions 270 are centrifugally forced away from the cam shaft 222. The centrifugal force on the flyweight portions 270 causes the blocking member 234 to pivot toward the disengaged position, as shown in FIGS. 10, 12 and 13. When the blocking member 234 reaches the disengaged position, as shown in FIG. 13, the tab 242 is no longer disposed between the cantilevered beam 238 and the cam shaft 222.

As illustrated in FIG. 10, a valve spring 286 biases the engine valve 230 toward a closed position. The spring biased engine valve 230 applies a force on the cam follower 226, which in turn applies a force on the cam 218. The cantilevered beam 238 is preferably made from a hardened material, such as metal or a similar material that is relatively flexible yet resilient and durable. When the blocking member 234 is in the disengaged position, the tab 242 is not disposed between the cantilevered beam 238 and the cam shaft 222, and the tab 242 does not support the cantilevered beam 238 against the force of the cam follower 226. The cantilevered beam 238 alone, without the tab 242, can not support the force of the valve spring 286 and cam follower 226. The valve spring 286 and cam follower 226 deflect the cantilevered beam 238 so the cam follower 226 may contact the cam 218. Therefore, once the blocking member 234 pivots to the disengaged position, the engine returns to a relatively normal engine cycle.

In the second embodiment, the blocking member 234 may also function as the compression release member 274. In addition, the blocking member 234 must pivot to the disengaged position before cantilevered beam 238 may deflect to allow the cam follower 226 to contact the cam 218. Therefore, the vacuum release mechanism 214 and the compression release member 274 of the second embodiment have similar kick-out speeds and disengage at approximately the same time. FIGS. 10, 12 and 13 illustrate the tab 242 pivoted away from the cantilevered beam 238, and the cantilevered beam 238 deflected to permit the cam follower 226 to contact the cam 218.

The cantilevered beam 238 is interconnected to the cam gear 262 with the bracket 266. Conventional fastening devices, such as screws, bolts, nuts, or rivets, may be used to fasten the bracket to the cam gear 266. The cam gear 266 may be made from a plastic material that may be heat deformed. As shown in FIG. 14, the bracket 266 may be alternatively fastened to the cam gear using plastic nubs 290 that extend from the cam gear 266 and may be melted to hold the bracket 266 in the proper position. In FIG. 14, a pre-melted nub 294 is represented by a dashed line. The pre-melted nub 294 is first placed through a hole 298 in the bracket 266. The nub 290 is exposed to a heat source that melts the nub 290 around the hole 298 to form a plastic integral rivet.

FIGS. 15–17 illustrate a third embodiment of the invention. In FIGS. 15–17, a centrifugally responsive vacuum release member 314 and a compression release member 318 are both interconnected to a single yoke 322 that is disposed near a cam 326 and a cam shaft 328. The yoke 322 is pivotably coupled to a cam gear 330 to pivot between an engaged position and a disengaged position. Two bosses 334 project from the cam gear 330, and a pin 338 extends through the bosses 334 and the yoke 322 to retain the yoke 322 to the cam gear 330. In the illustrated embodiment, the pin 338 does not pass through the cam shaft 328.

The yoke 322 is substantially U-shaped, and has a tab portion 342 and two flyweight portions 346. The tab portion 342 is disposed near the curved portion of the U-shaped yoke 322, and the flyweight portions 346 are disposed near the two ends of the yoke 322. The vacuum release member 314 is a tab that projects outward from the tab portion 342, in a direction opposite the cam shaft 328. The compression release member 318 may also be a tab that extends outward from the tab portion 342. The vacuum release member 314 and compression release member 318 both contact a cam follower 350 when the yoke 322 is in the engaged position at engine starting speeds. The vacuum release member 314 contacts the cam follower 350 to open an engine valve during the expansion stroke. In the illustrated embodiment, when the cam follower 350 contacts the vacuum release member 314 and compression release member 318, the tab portion 342 contacts the cam shaft 328, and the cam shaft 328 helps support the force exerted by the cam follower 350.

The flyweight portions 346 have sufficient mass to function as a flyweight. Once the engine reaches normal engine operating speeds, the flyweight portion 346 is centrifugally forced away from the cam shaft 328, causing the yoke 322 to pivot to the disengaged position. As illustrated in FIG. 17, the yoke 322 is in the engaged position, and a broken line 354 illustrates the yoke 322 in the disengaged position. Once the yoke 322 pivots to the disengaged position, the vacuum release member 314 and compression release member 318 no longer contact the cam follower 350. Since the vacuum release member 314 and the compression release member 318 are both interconnected to the yoke 322, the vacuum release member 314 and the compression release member 318 both have the same kick-out speed.

As illustrated in FIG. 16, the vacuum release member 314 and compression release member 318 are oriented in relation to the cam 326 to contact the cam follower 350 and open an exhaust valve during a specific stage of the engine cycle. The vacuum release member 314 contacts the cam follower 350 during the expansion stroke, and the compression release member 318 contacts the cam follower 350 during the compression stroke. As described above, the exhaust valve closes between the compression release member 318 and the vacuum release member 314, so the cam follower 350 contacts the cam 326 between the compression release member 318 and the vacuum release member 314.

FIGS. 19–21 illustrate a fourth embodiment of the invention. In FIGS. 19–21, a centrifugally responsive vacuum release member 414 and a compression release member 418 are both integrated into a single yoke 422. The yoke 422 is disposed near a cam 426 and a cam shaft 428, and curves around the cam shaft 428. The yoke 422 is pivotally coupled to a cam gear 430 to pivot between an engaged position and a disengaged position.

The yoke 422 is substantially U-shaped, and has an open end 434 and a curved closed end 438 disposed at opposite ends of the yoke 422. In FIG. 20, the vacuum release member 414 is a rounded bulge that extends outward from the curved closed end 438 and projects away from the cam shaft 428. In the illustrated embodiment, the compression release member 418 is also a rounded bulge that extends outward from the curved closed end of the U-shaped yoke 422. The vacuum release member 414 and compression release member 418 both contact a cam follower 442 as the cam gear 430 rotates and the yoke 422 is in the engaged position at engine starting speeds. The vacuum release member 414 contacts the cam follower 442 to open an engine valve during the expansion stroke. In the illustrated embodiment, when the cam follower 442 contacts the yoke 422, the closed end 438 contacts the cam shaft 428, which helps support the force exerted on the yoke 422 by the cam follower 442.

Two legs 446 extend from the curved closed end 438 toward the open end 434 of the U-shaped yoke 422. Two flyweight portions 450 are disposed at the ends of the legs 446 near the open end 434. As shown in FIG. 21, each leg 446 has a U-shaped recess 454 between the closed end 438 and the open end 434. A pin 458 extends through the recesses 454 to retain the yoke 422 to the cam gear 430. The recesses 454 are positioned between the pin 458 and the cam gear 430. The yoke 422 pivots about the pin 458 when pivoting between the engaged position and disengaged position.

As illustrated in FIGS. 19–21, the pin 458 is substantially C-shaped and has an elongated middle portion 462 and two end portions 466 that extend at an angle to the middle portion 462. The middle portion 462 is disposed in the recesses 454, and the end portions 466 extend into apertures 470 in the cam gear 430. In the illustrated embodiment, the apertures 470 extend in the axial direction of the cam gear 430 to facilitate the manufacture of the cam gear 430, which is generally made from a molding or casting process. Since the apertures 470 extend in the axial direction, the apertures 470 may be formed with a single pull during the manufacturing of the cam gear 430. If a hole would extend in a direction transverse to the axial direction of the cam gear 430, an additional pull during the gear manufacturing process may be necessary to form the hole. Reducing the number of pulls during manufacturing simplifies manufacturing and reduces the cost of the cam gear 430.

The design of the yoke 422 also simplifies manufacturing and reduces the cost of the yoke 422. The U-shaped recesses 454 that engage the pin 458 may be bent and eliminate the need to form a hole in the yoke 422. The vacuum release member 414 and the compression release member 418 are relatively co-planar with curved closed end 438, and the cam follower 442 contacts the edge of the vacuum release member 414 and compression release member 418. As shown in FIG. 21, the curved closed end 438 is substantially planar, but may have a slightly curved profile.

The yoke 422 may be formed with a stamping process which permits relatively accurate tolerances for the vacuum release member 414 and the compression release member 418. The vacuum release member 414 and compression release member 418 do not have to be bent or machine ground, which eliminates additional machining steps. Also, contact stress on the yoke 422 may be reduced because no sharp corner is created on the yoke 422 by grinding. The cam follower 442 contacts a relatively large radius on the vacuum release member 414 and compression release member 418, so the contact stress is reduced, such that the yoke 422 may not need to be hardened. Since the cam follower 442 contacts the edge of the curved closed end 438 and the curved closed end 438 is substantially planar, the force exerted by the cam follower 442 is substantially supported by the shaft 428. Alternatively, the force could be supported by the pin 458. Additionally, the yoke 422, pin 458 and cam gear 430 are relatively easy to assemble.

The flyweight portions 450 have sufficient mass to function as a flyweight. Once the engine reaches normal engine operating speeds, the flyweight portion 450 is centrifugally forced away from the cam shaft 428, causing the yoke 422 to pivot to the disengaged position. As illustrated in FIG. 21, the yoke 422 is in the engaged position, and a broken line 474 illustrates the yoke 422 in the disengaged position. Once the yoke 422 pivots to the disengaged position, the vacuum release member 414 and compression release member 418 no longer contact the cam follower 442 as the cam gear 430 rotates. Since the vacuum release member 414 and the compression release member 418 are both interconnected to the yoke 422, the vacuum release member 414 and the compression release member 418 both have the same kick-out speed. The cam gear 430 includes a stop 478 to prevent the yoke 422 from pivoting beyond the desired position of the disengaged position.

As illustrated in FIG. 20, the vacuum release member 414 and compression release member 418 are oriented in relation to the cam 426 to contact the cam follower 442 and open an exhaust valve during a specific stage of the engine cycle. The vacuum release member 414 contacts the cam follower 442 during the expansion stroke, and the compression release member 418 contacts the cam follower 442 during the compression stroke. As described above, the exhaust valve closes between the compression stroke and the expansion stroke so the cam follower 442 contacts the cam 426 between the compression release member 418 and the vacuum release member 414.

The foregoing detailed description describes only a few of the many forms that the present invention can take, and should therefore be taken as illustrative rather than limiting. It is only the following claims, including all equivalents that are intended to define the scope of the invention.

What is claimed is:

1. An internal combustion engine, comprising:

a reciprocable piston;

a combustion chamber disposed on a first side of the piston;

a crankcase disposed on a second side of the piston opposite to the first side;

a valve operating system comprising;

a cam;

an engine valve movable in response to movement of the cam;

a centrifugally-responsive vacuum release mechanism disposed adjacent the cam, wherein the valve is at least partially opened in response to movement of the centrifugally-responsive vacuum release mechanism, while the piston is moving toward the crankcase and away from the combustion chamber, said vacuum release member including:

a beam having a cam surface that engages a cam follower at engine starting speeds; and a blocking member, movable between an engaged position and a disengaged position, that engages the beam at engine starting speeds.

2. The engine of claim 1, wherein the beam is cantilevered.

3. The engine of claim 1, wherein the blocking member comprises a tab disposed between the beam and a cam shaft when the blocking member is in the engaged position.

4. The engine of claim 1, wherein the blocking member is pivotably coupled to a cam shaft.

5. The engine of claim 1, wherein the blocking member prevents a cam follower from fully deflecting the beam when the blocking member is in the engaged position.

6. The engine of claim 1, wherein the vacuum release mechanism is disposed at a position adjacent the cam such that the cam surface may engage a cam follower while the piston is moving toward the crankcase and away from the combustion chamber.

7. The engine of claim 1, wherein the cam surface separates the cam follower from the cam when the blocking member is in the engaged position.

8. The engine of claim 1, wherein a spring biases the blocking member toward the engaged position.

9. The engine of claim 1, wherein the blocking member is in the engaged position when the engine is operating at starting speeds.

10. The engine of claim 1, wherein the blocking member moves to the disengaged position when the engine reaches normal operating speeds.

11. The engine of claim 1, wherein a cam follower deflects the beam when the blocking member is in the disengaged position.

12. The engine of claim 1, wherein the beam includes a bracket disposed at an end of the beam opposite the cam surface.

13. The engine of claim 12, wherein a gear is interconnected to the cam shaft, and the bracket is interconnected to the gear.

14. The engine of claim 13, wherein at least one melted nub is used to interconnect the bracket to the gear.

15. The engine of claim 11, further comprising:

a cam shaft interconnected to the cam;

a gear interconnected to the cam shaft; and a yoke pivotably coupled to the gear, wherein the centrifugally-responsive vacuum release mechanism is interconnected to the yoke.

16. The engine of claim 1, wherein the yoke is pivotable between an engaged position and a disengaged position.

17. The engine of claim 16, wherein the vacuum release mechanism includes a tab that extends outward from the yoke, and the vacuum release mechanism engages a cam follower when the yoke is in the engaged position.

18. The engine of claim 16 wherein the vacuum release mechanism extends beyond the cam when the yoke is in the engaged position.

19. The engine of claim 16, wherein the vacuum release mechanism separates a cam follower from the cam when the yoke is in the engaged position.

20. The engine of claim 16, wherein the yoke includes a centrifugally-responsive compression release member.

21. The engine of claim 20, wherein the compression release member engages a cam follower, and separates the cam follower from the cam when the yoke is in the engaged position.

22. The engine of claim 15, wherein the yoke is substantially U-shaped and includes:

a tab portion near the curved, closed end of the U-shaped yoke; and a flyweight portion near the near the open end of the yoke, the flyweight portion having sufficient mass to move the yoke in response to engine speed.

23. The engine of claim 22, wherein the yoke pivots about a pivot axis disposed between the tab portion and the flyweight portion.

24. The engine of claim 22, wherein the yoke at least partially surrounds the cam shaft.

25. The engine of claim 15, wherein the yoke is substantially U-shaped and includes a curved closed end and an open end, and the vacuum release mechanism includes a bulge that extends outward from the closed end.

26. The engine of claim 25, wherein the bulge of the vacuum release mechanism is substantially planar with the closed end.

27. The engine of claim 25, wherein the yoke includes at least two legs that extend between the closed end and the open end, and each leg has a recess.

28. The engine of claim 27, wherein the recesses are U-shaped.

29. The engine of claim 27, further comprising a pin retaining the yoke to the gear, the pin having a middle portion extending through the recesses, and two end portions extending into apertures in the gear.

30. The engine of claim 29, wherein the pin is at least partially disposed in the recess and the yoke pivots about the pin.

31. The engine of claim 29, wherein the pin is C-shaped.

32. The engine of claim 29, wherein the apertures extend in the axial direction of the gear.

* * * * *